US009701036B2

(12) United States Patent
Dion

(10) Patent No.: US 9,701,036 B2
(45) Date of Patent: Jul. 11, 2017

(54) HAND TOOL FOR PUNCHING SHEET MATERIAL

(71) Applicant: Travis Dion, Fort St John (CA)

(72) Inventor: Travis Dion, Fort St John (CA)

( * ) Notice: Subject to any disclaimer, the term of this patent is extended or adjusted under 35 U.S.C. 154(b) by 0 days.

(21) Appl. No.: 14/728,322

(22) Filed: Jun. 2, 2015

(65) Prior Publication Data

US 2015/0266200 A1 Sep. 24, 2015

(51) Int. Cl.
*B26F 1/36* (2006.01)
*B21D 28/34* (2006.01)
*B21D 35/00* (2006.01)

(52) U.S. Cl.
CPC ..... *B26F 1/36* (2013.01); *B21D 28/34* (2013.01); *B21D 35/003* (2013.01); *B26F 2001/365* (2013.01)

(58) Field of Classification Search
CPC ..... B26F 1/36; B26F 2001/365; B21D 28/34; B21D 35/003
USPC ..... 30/363
See application file for complete search history.

(56) References Cited

U.S. PATENT DOCUMENTS 818,783 A * 4/1906 Philippi ..... B26F 1/36 30/363
824,551 A * 6/1906 Levis ..... B21D 28/10 493/343
3,274,687 A * 9/1966 Le Blanc ..... G03D 15/043 30/360
4,033,037 A * 7/1977 Cooley ..... B21D 28/24 30/363
5,022,253 A * 6/1991 Parlatore ..... B21D 39/034 30/363
5,101,566 A * 4/1992 Crapo ..... B21D 28/243 30/358
5,622,076 A 4/1997 Welty
6,789,593 B1 9/2004 Aono
6,807,961 B2 * 10/2004 Burrows ..... B28D 1/223 125/23.01
7,146,738 B2 12/2006 Yu
7,610,838 B2 11/2009 Kent
2012/0174719 A1 7/2012 Kaufman
2015/0266200 A1 * 9/2015 Dion ..... B26F 1/36 30/363

* cited by examiner

*Primary Examiner* — Hwei C Payer
*Assistant Examiner* — Hwei-Sin C. Payer
(74) *Attorney, Agent, or Firm* — Global Intellectual Property Agency, LLC; Daniel Boudwin

(57) ABSTRACT

A punch tool is provided that is adapted to create a pair of spaced apart apertures through a thin-walled work piece when clamped. The device comprises a hand tool having a pair of handles and a tool head comprising a first head portion and a second head portion. The head portions pivot away from each other and bear against one another based on movement of the handles to compress a sheet of material therebetween. The head portions are T-shaped members, in which the first head portion supports a pair of dies and the second head portion supports a pair of punches adapted to be received by the dies. The head portions are clamped together, whereby the dies are punched through the work piece sheet material to form spaced apart apertures. An embodiment of the head portions contemplates an adjustable width for varying the spacing of the punches.

6 Claims, 4 Drawing Sheets

HAND TOOL FOR PUNCHING SHEET MATERIAL

BACKGROUND OF THE INVENTION

Field of the Invention

The present invention relates to a punch tool for creating a pair of spaced apart apertures into sheet metal using a pair of manually operated handles for input. More specifically, the present invention provides a punch tool that comprises a pair of head portions that are pressed together to punch a pair of holes through a sheet material work piece, which is particularly useful when creating new connection points in cable tray material to connect adjacent lengths of cable trays together.

In commercial electrical construction, cable trays are used to support bundles of cable and other electrical wiring from ceilings and wall structures. These include elongated trays that support the cable along long lengths for cable management purposes. Typical materials for these trays are steel sheet metal, aluminum, and plastics.

When fitting adjoining trays together, a common connection method involves a pair of factory stamped, square holes and complimentary flanges that engage the square holes. This connection prevents the trays from pulling apart once connected and supported by the adjacent structure. The connection points are generally positioned at the distal ends of precut tray lengths. When installing cable trays intermediate length with regard to their precut length, modification of the trays and fabrication of new connector holes is necessary to join the adjacent lengths.

Common methods of modifying the cable trays to fit shorter spaces include cutting the precut lengths and then creating new square hole connection points. The fabrication during installation often falls short of precise while in the field. As a result, the connections can be haphazard and result in improper fitment when the trays are aligned and connected. The present invention provides a punch tool for punching spaced apart holes through sheet material that is well adapted for modification of cable trays.

While the application of creating square apertures in cable trays is described above and is a useful application of the present invention, this singular application should not be construed as the sole use or only application of the present invention. The tool of the present invention is a general purpose punch tool that can create a pair of apertures through sheet metal using a pair of head portions and elongated handles that press the head portions together to punch holes through the material between the head portions. Along with providing a general purpose punching tool, it should furthermore be understood that the punch protrusions and complementary punch dies may be formed having any desired shape.

SUMMARY OF THE INVENTION

The following summary is intended solely for the benefit of the reader and is not intended to be limiting in any way. The present invention provides a new hand tool for punching sheet material using a pair of handles and a pair of head portions that clamp the sheet material.

It is therefore an object of the present invention to provide a new and improved punch tool device that has all of the advantages of the prior art and none of the disadvantages.

It is another object of the present invention to provide a hand tool that is suited for punching spaced apart holes through sheet material.

Another object of the present invention is to provide a hand tool that comprises a pair of handles that control a pair of head portions, whereby the head portions clamp a sheet material work piece and press a pair of punches through a pair of dies to create defined apertures in the sheet material.

Yet another object of the present invention is to provide a hand tool that is particularly suited for punching apertures in cable trays when fabricating connections between adjacent lengths.

Another object of the present invention is to provide a hand tool that comprises head portions that are adjustable, whereby the spaced apart apertures created by the tool can be controlled and set for the given application.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
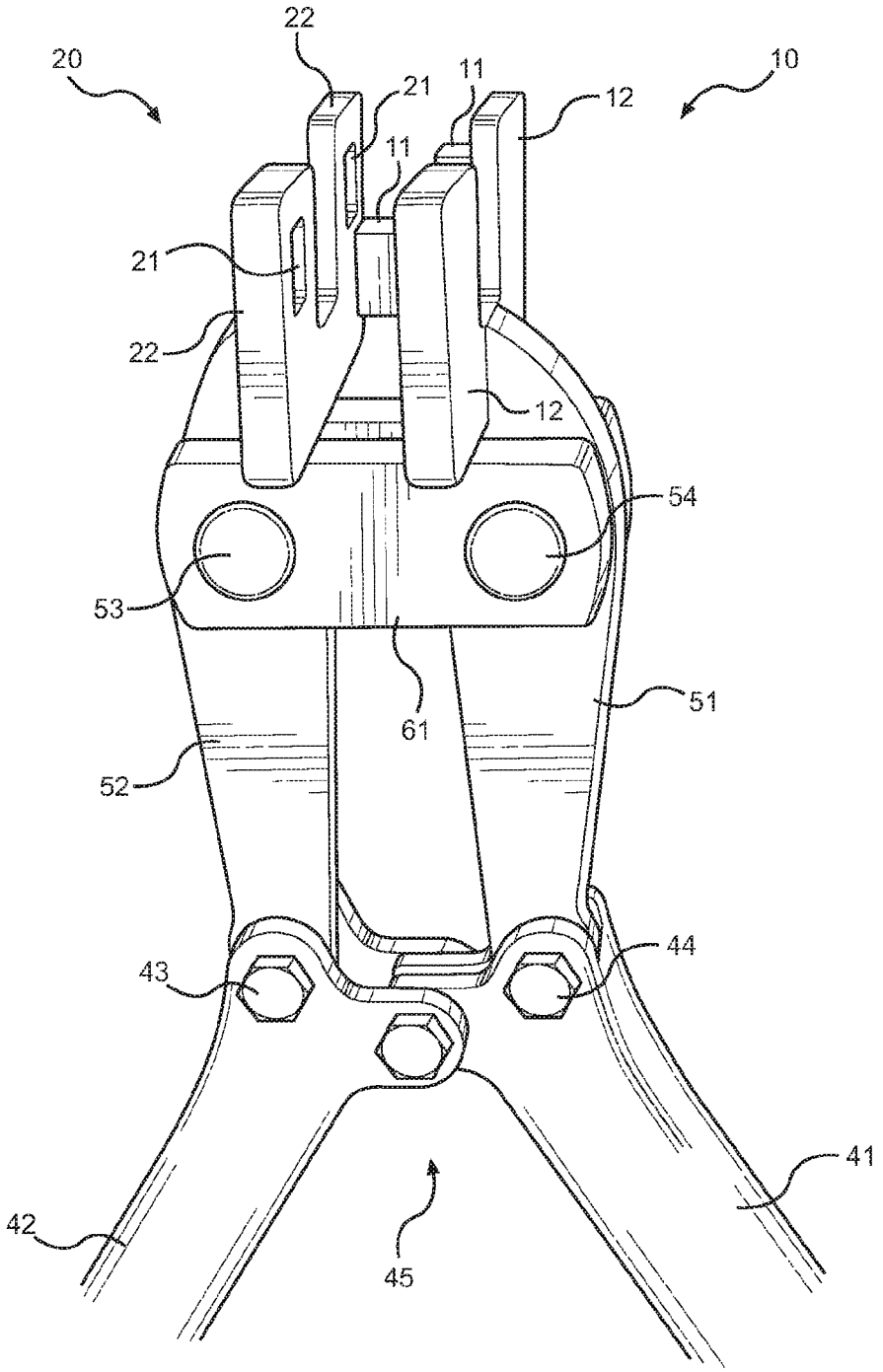
FIG. 1 shows a view of the first and second tool head portions along the working end of the tool.

Reference is made herein to the attached drawings. Like reference numerals are used throughout the drawings to depict like or similar elements of the punch tool of the present invention. For the purposes of presenting a brief and clear description of the present invention, the preferred embodiment will be discussed as used for punching spaced apart apertures through sheet material using a clamping tool and manual user input through the elongated handles of the tool. The figures are intended for representative purposes only and should not be considered to be limiting in any respect.

Referring now to FIG. 1, there is shown a perspective view of the punch tool of the present invention, and particularly of the head of the tool. The tool comprises a hand tool having a first handle 42 and a second handle 41 that are used to operate the tool head. The tool head performs a punching operation, whereby a pair of spaced apart apertures can be punched through sheet material when the first head portion 20 and the second head portion 10 are pressed together and clamp the sheet material therebetween. The head portions are hinged relative to one another and actuated by way of the handles, whereby the user can operate the handles to apply pressure to the sheet material work piece between the head portions.

The tool is used to create spaced apart apertures, whereby the apertures a clean hole through the material that take on a defined shape. The shape of the apertures is defined by the head portions, which comprise a pair of punches 11 and a pair of complimentary punch-receiving dies 21. The dies 21 are disposed opposite of the punches 11, whereby the second head portion supports the punches 11 and the first head portion supports the dies 21, respectively. When the head portions are pressed together, the punches 11 enter the dies 21. The punches are pressed through the material work piece placed between the head portions, whereby the user applies force to the handles to supply sufficient energy for the punching operation.

Figure 2:
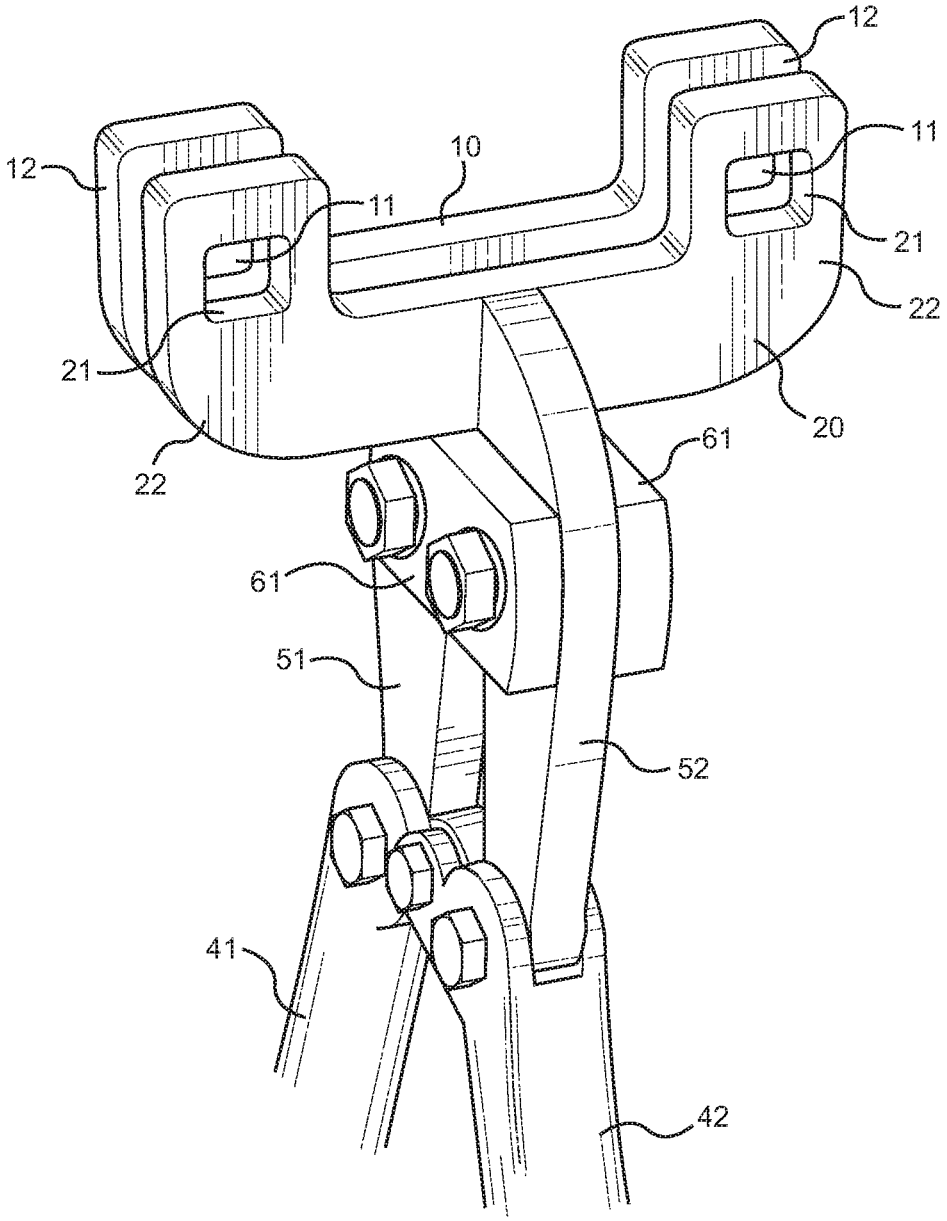
FIG. 2 shows another perspective view of the first and second tool head portions along the working end of the tool.
Figure 3:
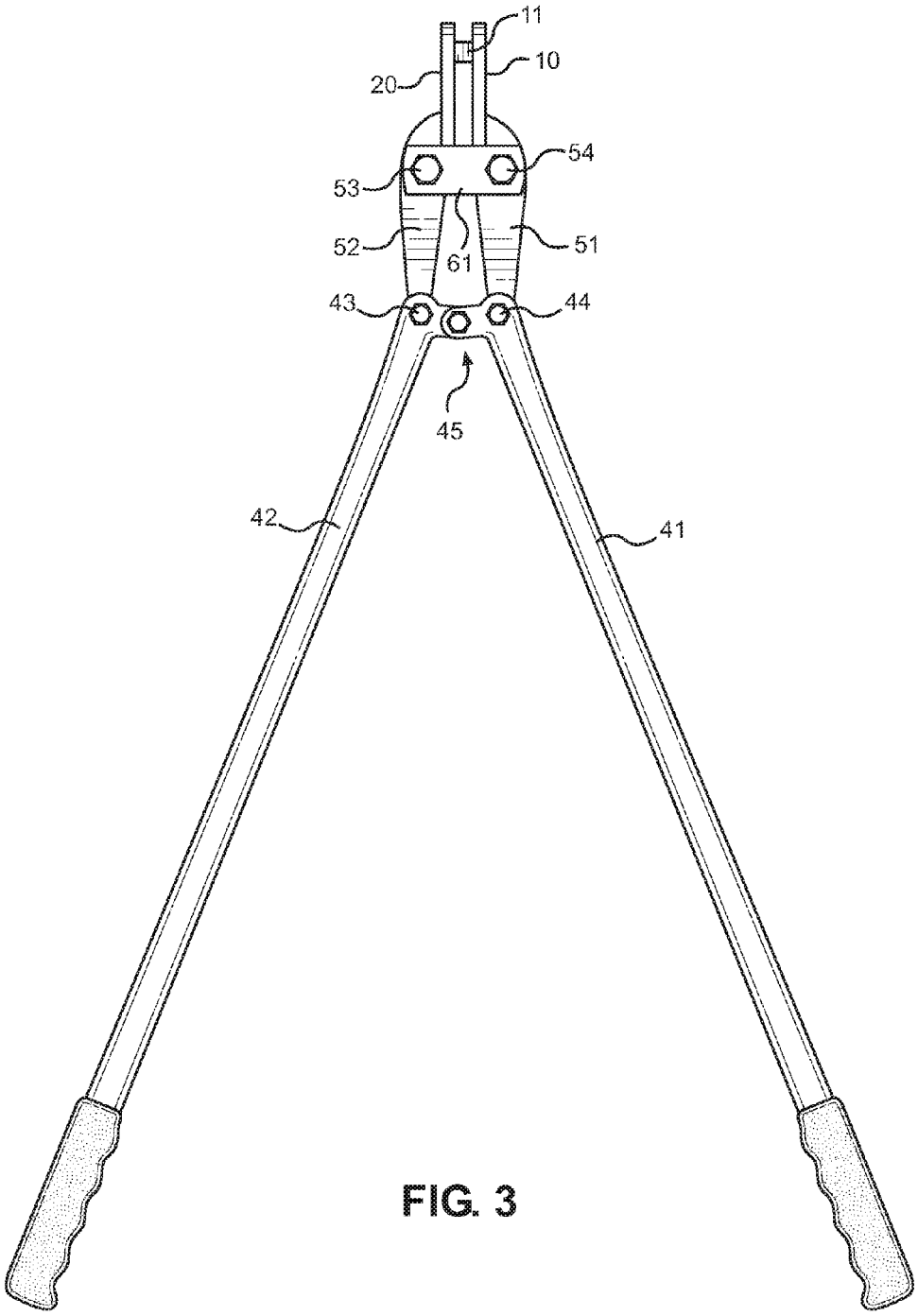
FIG. 3 shows a view of the tool in its entirety, including the elongated handles.

Referring to FIGS. 1-3, the first 20 and second 10 head portions each comprise a substantially T-shaped structure with a first and second outer end. Specifically, the first head portion 20 comprises a T-shaped structure with a first and second outer end 22, while the second head portion 10 comprises also comprises a T-shaped structure with its own first and second outer end 12. The first head portion includes a first and second punch-receiving die 21 disposed within the outer ends 22 thereof. The dies 21 are adapted to receive the complimentary punch 11 extending from the second head portion. The second head portion includes a first and second punch 11 extending therefrom and disposed along the outer ends 12 thereof. The punches 11 are protruding members extending from the inner surface of the second head portion 10, which are aligned with the dies 21 of the first head portion such that the punches are received by the dies when the head portions are pressed tighter. The inner surfaces of the head portions abut against each other when the two are pressed together by way of the handles.

Supporting the first and second head portions and controlling their position relative to each other are the handles 41, 42, which may connect directly to the head portions or may connect thereto using a pair of intermediate members 51, 52. In one embodiment, the handle member 41, 42 are hinged to each other and directly connect to the head portions. The handles 41, 42 may overlap each other at the hinge joint and comprise a defined curve or bend. This direct connection affords one of two methods of pressing the head portions together. That is, the handles may be pressed together to draw the head portions together, or alternatively the handle portions may be pulled apart to press the head portions together.

In the embodiment shown in the drawing views, a levered configuration is provided. This configuration is similar to bolt cutter tools. This structure amplifies the mechanical advantage by providing intermediate members 51, 52 that are driven by the handles 41, 42, whereby the handles act as levers and the intermediate members are supported by cross members 61 that act as a fulcrum points. As the handles 41, 42 are pressed together, the lower end of the intermediate members 51, 52 separate, while the upper ends of the intermediate members 51, 52 are drawn together. The upper ends of the intermediate members 51, 52 are connected to the first and second head portions 20, 10. In this configuration, the handles are pivotably connected at a pivot point 45. The upper ends of the handles are pivotably connected to the lower ends of the intermediate members 51, 52 and pivot the intermediate members about the cross members 61. The cross members 61 are likewise pivotably connected at a fulcrum point 53, 54 along the intermediate members. This fulcrum point 53, 54 allows the intermediate members to pivot the head portions 10, 20 together and to separate the same based on the position of the handles 41, 42.

Thus, the first handle 42 and second handle 41 are connected at a pivot point 45. The first tool head portion 20 comprises an elongated intermediate portion 52 disposed above the pivot point 45 and pivotably connected 43 to the first handle 42. The second tool head portion 10 further comprises an elongated intermediate portion 51 disposed above the pivot point 45 and pivotably connected 44 to the second handle 41. Cross members 61 pivotably connect to the intermediate members 51, 52 at the ends thereof to form fulcrum points 53, 54 for the first intermediate member 52 and the second intermediate member 51. When the handles 41, 42 are pressed together, the upper end of the handles separates the lower ends of the intermediate members 51, 52, causing the head portions 10, 20 to come together along the opposite end of the fulcrum points 54, 53. The handles are preferably elongated to improve the mechanical advantage of the tool when pressing the punches 11 through the material work piece and into the punch-receiving dies 21.

Figure 4:
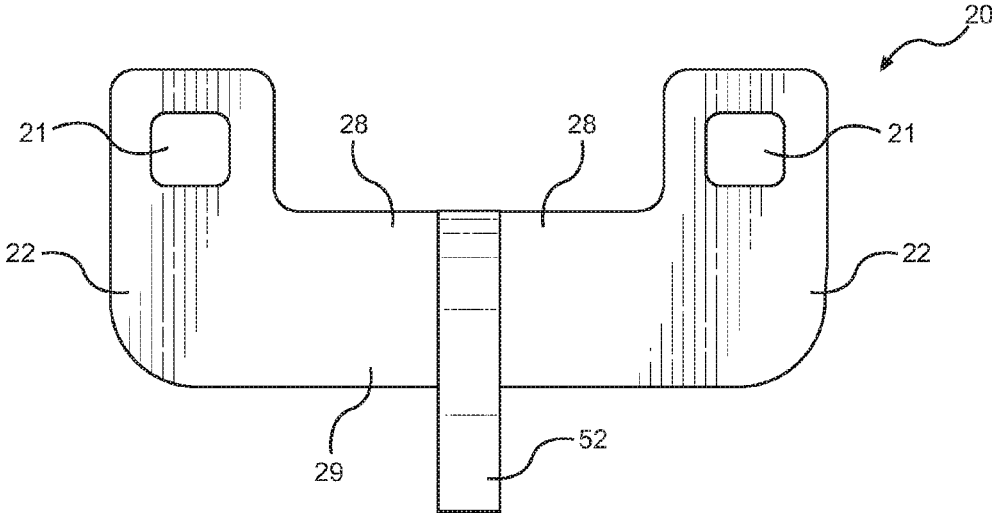
FIG. 4 shows a side view of the first head portion and the punch-receiving dies thereof.

Referring now to FIG. 4, there is shown a view of the first head portion 20 from a side view. The head portions comprise a substantially T-shaped construction with a first and second outer end 22. The outer ends 22 may include an upstanding portion within which the die 21 or punch is located, however the punch and dies are separated from one another by the length 28 of the outer ends 22. The separation allows the punched holes to be a given distance from one another. The head portions are driven by the intermediate member 51, which is secured to the outer surface 29 of the head portions and drives the head portions together.

Figure 5:
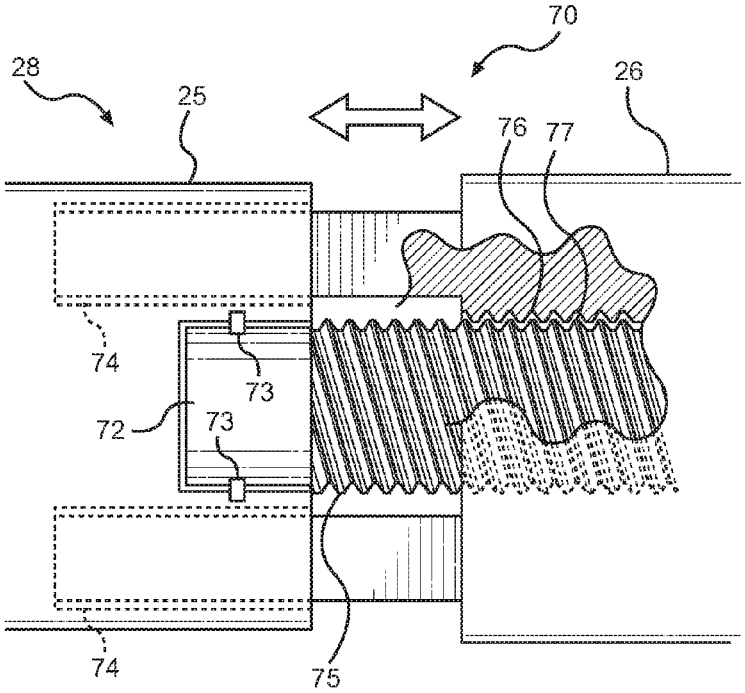
FIG. 5 shows a close-up view of one of the head portions, and a contemplated adjustment assembly for adjusting the separation between the outer ends of each head portion.

Referring finally to FIG. 5, there is shown an assembly 70 that is adapted to be disposed within the length 28 of the head portion outer ends for separating the punch and dies a desired distance. Therefore, the outer ends of the head portions are length adjustable, whereby the separation of the punches created in the work piece can be varied depending on the application. In one embodiment, and as shown in FIG. 5, the outer ends may comprise an adjustable length 28 that is separable and controlled by way of a threaded member 75 within the interior of the outer ends. The threaded member 75 is captive and rotated in place, which drives the outboard segment of the outer portion from an inboard section. In this way, the user can rotate the threaded member to change the distance between the punches and between the dies as required.

Specifically, the outer ends 28 of each head portion comprise an inboard segment 25 and an outboard segment 26 that are separable. The threaded member 75 is captively disposed within the inboard segment 25, whereby the outer surface 72 of the threaded member is exposed along the inboard segment 25. The user can rotate the threaded member 75 by physically rolling the member, whereby outer surface is pressed upon and rolled during this operation. A pair of notches 73 holds the threaded member 75 in place within the inboard segment 25 while still accommodating axial rotation thereof. The opposite end of the threaded member 75 is threadably engaged with an elongated channel 77 within the outboard segment 26. The elongated channel 77 comprises complimentary threads 76, whereby rotation of the threaded member 75 drives the outboard segment 26 away or towards the inboard segment 25, depending on the rotation thereof. To prevent the outboard segment 26 from rotating, a pair of dowels 74 extends from the outboard segment 26 and into the inboard segment 25. This in turn allows rotation of the threaded member 75 to translate the outboard member 26 relative to the inboard member 25 of the head portion when the threaded member 75 is rotated.

Overall, the present invention provides a manually operated punch tool that can be used to create defined apertures in sheet material. The punches and the punch-receiving dies can be shaped and sized in a desired configuration, including rectangularly shaped, rounded shaped, or the like. The tool clamps the material work piece and the handles are used to force the punch through the work piece and into the punch-receiving dies. The user can quickly and efficiently create apertures in sheet material without resorting to other, less attractive fabrication methods. The punches can be statically disposed and at a premeasured distance from one another, or alternatively the tool may include an adjustment assembly for altering the distance between the pair of punches and the pair of dies.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A punch tool, comprising:

a first handle and a second handle in pivotal relationship to each other and connected to a first tool head portion and a second tool head portion, respectively;

the first tool head portion comprising a substantial T-shape with a first outer end and a second outer end;

the first and second outer ends of the first tool head portion each comprising a punch receiving die therethrough;

the second tool head portion comprising a substantial T-shape with a first outer end and a second outer end;

the first and second outer ends of the second tool head portion each comprising a protruding punch extending therefrom;

the punch receiving dies of the first tool head portion being adapted to receive the protruding punches of the second tool head portion when the first tool head portion is pressed against the second tool head portion;

the protruding punches being adapted to punch spaced apart apertures through a work piece when the first tool head portion is pressed against the second tool head portion and the work piece is therebetween.

2. The punch tool of claim 1, wherein:

the first tool head portion is pressed against the second tool head portion when the first handle and the second handle are pressed together.

3. The punch tool of claim 1, wherein:

the first tool head portion is pressed against the second tool head portion when the first handle and the second handle are pulled away from each other together.

4. The punch tool of claim 1, wherein:

the first handle and the second handle are connected at a pivot point;

the first tool head portion further comprises an elongated intermediate portion disposed above the pivot point and pivotably connected to the first handle;

the second tool head portion further comprises an elongated intermediate portion disposed above the pivot point and pivotably connected to the second handle;

a cross member pivotably connected at its ends to the elongated intermediate portions of the first tool head portion and the second tool head portion to form fulcrum points for the elongated intermediate portions;

wherein the first tool head portion is pressed against the second tool head portion when the first handle and the second handle are pressed together.

5. The punch tool of claim 1, wherein:

the first tool head portion further comprises a length adjuster that is adapted to control the separation of the first outer end and the second outer end thereof; and wherein the second tool head portion comprises a length adjuster that is adapted to control the separation of the first outer end and the second outer end thereof.

6. The punch tool of claim 1, wherein:

the first tool head portion further comprises a length adjuster that is adapted to control the separation of the first outer end and the second outer end thereof;

wherein at least one of the first and second outer ends of the first tool head portion is slidably adjustable relative to the first tool head portion and comprises a first threaded member extending into the first tool head portion;

wherein the length adjuster further comprises a captive rotatable member that engages the first threaded member and to threadably extend or retract the at least one of the first and second outer ends of the first tool head portion;

the second tool head portion further comprises a length adjuster that is adapted to control the separation of the first outer end and the second outer end thereof;

wherein at least one of the first and second outer ends of the second tool head portion is slidably adjustable relative to the second tool head portion and comprises a second threaded member extending into the second tool head portion;

wherein the length adjuster further comprises a captive rotatable member that engages the second threaded member and to threadably extend or retract the at least one of the first and second outer ends of the second tool head portion.

* * * * *